US005758560A

United States Patent [19]

Fiscus

[11] Patent Number: 5,758,560

[45] Date of Patent: Jun. 2, 1998

[54] ANVIL COVER LATCH ASSEMBLY

[75] Inventor: Donald L. Fiscus, Butler, Pa.

[73] Assignee: C.U.E. Inc., Cranberry Township, Pa.

[21] Appl. No.: 755,722

[22] Filed: Nov. 25, 1996

Related U.S. Application Data

[63] Continuation of Ser. No. 369,007, Jan. 5, 1995, abandoned.

[51] Int. Cl.[6] ..... B26D 7/20

[52] U.S. Cl. ..... 83/659; 83/347; 83/698.42

[58] Field of Search ..... 83/347, 348, 659, 83/698.42; 492/22, 53, 56; 101/415.1

[56] References Cited

U.S. PATENT DOCUMENTS

| | | | |
|---|---|---|---|
| 3,602,970 | 9/1971 | Smith | 83/659 X |
| 3,633,246 | 1/1972 | Kirkpatrick | 24/19 |
| 3,765,329 | 10/1973 | Kirkpatrick | 83/659 X |
| 4,031,600 | 6/1977 | Whigham | 83/347 X |
| 4,073,207 | 2/1978 | Kirkpatrick | 83/659 X |
| 4,075,918 | 2/1978 | Sauer | 83/659 X |
| 4,191,076 | 3/1980 | Bollmer et al. | 83/698.42 X |
| 4,848,204 | 7/1989 | O'Connor et al. | 83/659 |
| 4,867,024 | 9/1989 | Cho et al. | 83/347 X |
| 4,982,639 | 1/1991 | Kirkpatrick | 83/659 |
| 5,076,128 | 12/1991 | O'Connor et al. | 83/659 |
| 5,078,535 | 1/1992 | Kirkpatrick | 403/339 |

*Primary Examiner*—Rinaldi I. Rada
*Assistant Examiner*—Boyor Ashley
*Attorney, Agent, or Firm*—Webb Ziesenheim Bruening Logsdon Orkin & Hanson, P.C.

[57] ABSTRACT

The present invention is an anvil cover latch assembly which includes a female latch member having a generally U-shaped frame. The frame has an upper segment, a side segment and a base segment with the base segment having an upwardly angled end section. The upper segment, side segment and base segment are configured to form a channel into which is cast an insert of elastically deformable material. The insert is disposed such that a locking edge is formed by an exposed portion of a lower surface of the upper segment. A male latch member has a substantially planar shoulder region which is designed to engage the locking edge on the female portion.

13 Claims, 2 Drawing Sheets

ANVIL COVER LATCH ASSEMBLY

This application is a continuation of application Ser. No. 08/369,007 filed on Jan. 5, 1995, now abandoned.

BACKGROUND OF THE INVENTION

1. Field of the Invention

This invention relates generally to latch assemblies for flexible, annular covers and, more particularly, to a latch assembly to secure an anvil cover to an anvil head.

2. Description of the Prior Art

Rotary die cutting machines are used in numerous applications. In the corrugated box industry, for example, they are used to score and/or cut heavy corrugated paperboard into various shapes, sizes and patterns so that the boards can be joined into end-use configurations, such as boxes and shipping containers. These rotary die cutting machines are equipped with at least two cylinders. One cylinder, called a cutting roller, contains numerous cutting or scoring elements arranged along its outer, annular surface. A second cylinder supports the board at the point where the cutting or scoring elements make their impression. In effect, the second cylinder acts as an anvil and is, therefore, called an anvil head.

In order to protect the cutting elements from excessive wear and possible damage, the anvil head supporting the corrugated board is fitted with at least one cover or blanket which has an outer surface or layer of composite or polymeric material called an anvil cover. The outer surface of the cover is sufficiently rigid to give adequate support to the paperboard, yet soft enough so that the cutting elements will not wear or be damaged by impact with the cylinder. The anvil cover is wrapped around the anvil head so that the ends of the cover meet at a slot disposed on the face of the anvil head. The ends of the anvil cover are then latched together.

From time to time, cutting operations must be stopped to replace a worn anvil cover. The time the die cutting machine is not used for cutting operations obviously represents an economic loss. Additionally, the labor required in changing an anvil cover is costly. Therefore, the time required to replace a worn anvil cover should be kept to a minimum.

In certain anvil covers of prior art construction, a metal cylinder is surrounded by a two-piece slip bearing of hard polyurethane or metal. The slip bearing includes a slot having parallel sides, a flat base wall and a groove running between each side wall and the base wall. An example of this configuration is shown in FIG. 2. After the slip bearing is placed around the metal cylinder, an anvil cover is wrapped around the slip bearing and latched into the slip bearing slot, thus holding the slip bearing and anvil cover in place around the metal cylinder. The slip bearing carrying the anvil cover is freely rotatable around the metal cylinder. Anvil covers configured for use with this type of anvil head are known in the art. For example, U.S. Pat. No. 5,076,128 discloses an anvil cover for an anvil head as shown in FIG. 2 in which a female latch member, attached to one end of the anvil cover, is inserted into the slip bearing slot. A planar base element of the female latch member is inserted into a groove running along the base of the slip bearing slot. The anvil cover is then wrapped around the anvil head and a flexible male latch member attached to the other end of the anvil cover is inserted into a channel in the female latch member. However, anvil covers with this type of latch assembly have a tendency to pull away from the surface of the slip bearing in the vicinity of the slip bearing slot causing a transverse ridge or hump to be formed on the outer surface of the anvil cover. This ridge interferes with the smooth operation of the rollers and is detrimental to the rotary die cutting procedure. More importantly, this prior art anvil cover is difficult to mount because of the amount of compression required to force the male member into the final position within the female member. Other forms of latch assemblies for anvil covers and rotary die or anvil blankets are illustrated in U.S. Pat. Nos. 3,633,246; 4,848,204; 4,982,639; and 5,078,535.

Therefore, it is an object of the present invention to provide an improved anvil cover latch assembly for use with a prior art anvil head of the type shown in FIG. 2, which is inexpensive to manufacture, easy to lock and unlock, i.e., to assemble, and able to securely hold an anvil cover to the anvil head and slip bearing without allowing ridges or humps to be formed on the outer surface of the anvil cover. It is further an object to provide an anvil cover latch assembly which provides ease of installation in applications where a plurality of anvil covers are installed side by side along one anvil head.

SUMMARY OF THE INVENTION

The present invention is an anvil cover latch assembly for use with a cover for an anvil head having a cylindrical periphery provided with a slot where the slot includes opposed, substantially parallel side walls, a base wall and at least one groove having a curved surface provided along the slot adjacent the base wall. The latch assembly includes a female member having a generally U-shaped frame with an upper segment, side segment and base segment configured to form a channel. The base segment includes an angled end section and the base segment is of sufficient length such that when the female member is placed in the slot, the angled end section extends into the groove and substantially abuts the curved surface. An insert of an elastically deformable material is disposed in the channel such that a locking edge is formed by an exposed portion of a lower surface of the upper segment. The latch assembly further includes a male member having a planar shoulder region and the male member is configured to engage the female member.

DESCRIPTION OF THE PREFERRED EMBODIMENT

Figure 1:
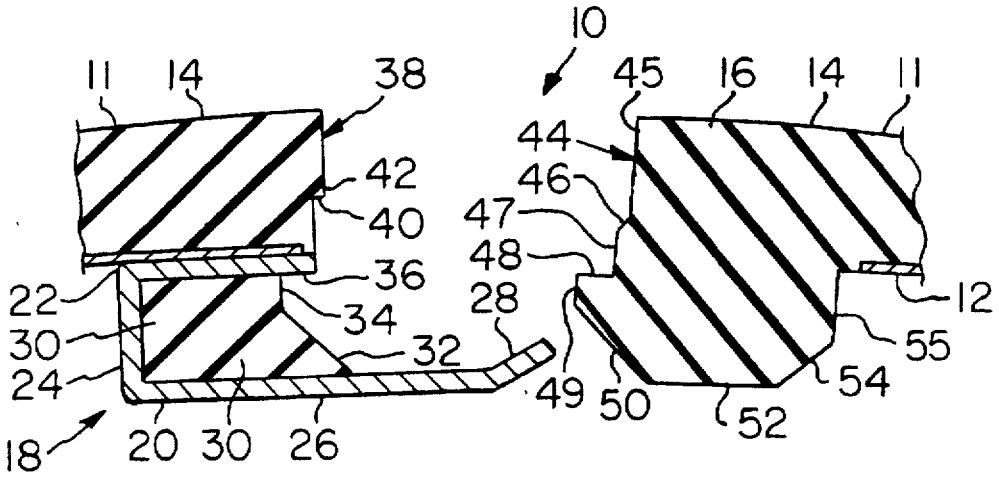
FIG. 1 is a cross-sectional view of an anvil cover latch assembly of the present invention.
Figure 3:
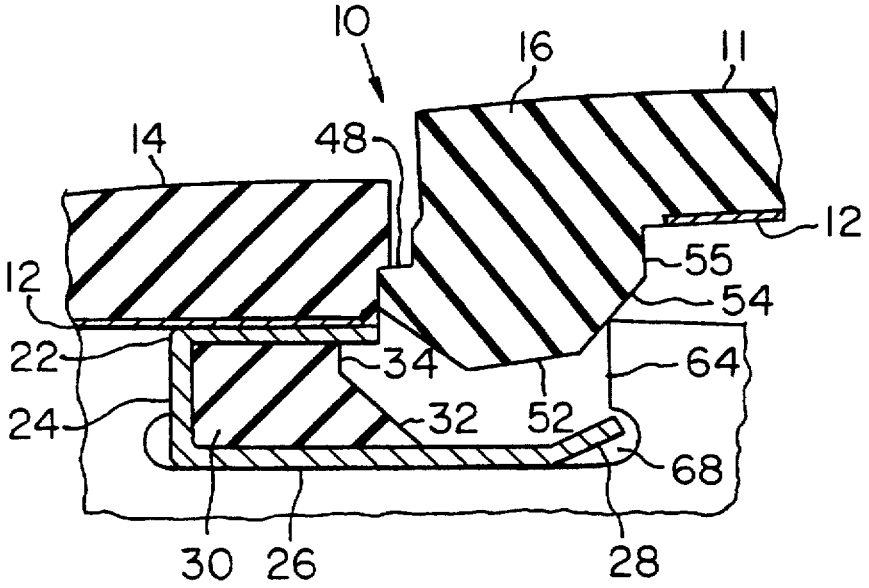
FIG. 3 is a cross-sectional view of the anvil cover latch assembly of FIG. 1 in a pre-lock, holding configuration.
Figure 4:
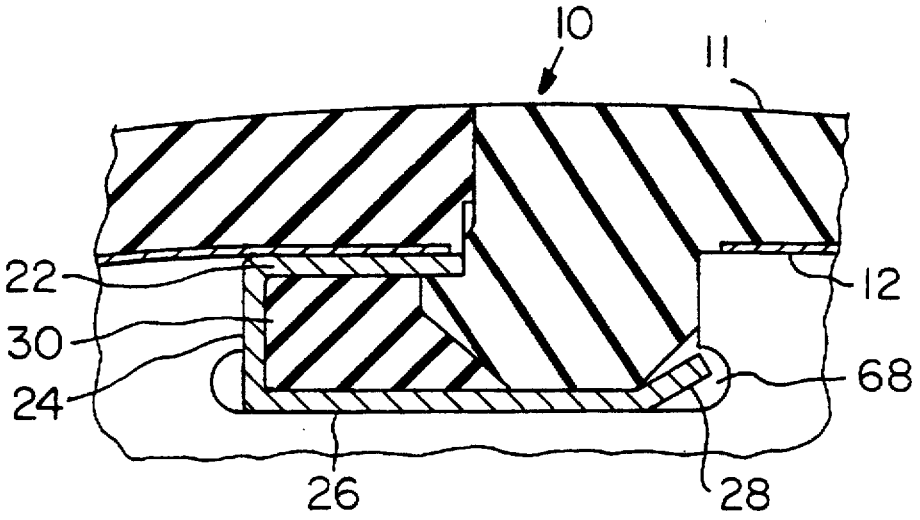
FIG. 4 is a cross-sectional view of the anvil cover latch assembly of FIG. 1 secured to the anvil head of FIG. 2.

An anvil cover latch assembly of the present invention is generally designated 10 in FIGS. 1, 3 and 4 of the drawings. An anvil cover 11 includes a flexible, metal band 12 with a layer of an elastically deformable material 14, such as elastomeric urethane, bonded in conventional manner to an outer surface of metal band 12. A male latch member 16 is disposed at one end of cover 11 and a female latch member 18 is disposed at an opposite end of cover 11.

As shown in FIG. 1, female latch member 18 includes a generally U-shaped metal frame 20 having an upper segment 22, a side segment 24 and a base segment 26. Base segment 26 includes an angled end section 28 remote from side segment 24. Upper segment 22 is shorter than, and substantially parallel to, base segment 26 such that a generally rectangular channel is formed between upper segment 22, side segment 24 and base segment 26. An outer surface of upper segment 22 is attached to an inner surface of band 12 by conventional methods, such as welding. An insert 30 of the same elastically deformable material 14 of which cover 11 is formed is cast in the rectangular channel as shown in FIG. 1. Insert 30 fills approximately one-half of the channel and includes an outwardly exposed, sloping first section 32 and a substantially planar second section 34. First section 32 and second section 34 are formed at an obtuse angle. Insert 30 is configured in the channel such that a locking edge 36 is formed by an exposed portion of the inner surface of upper segment 22 remote from side segment 24. An end face 38 of material 14 above female latch member 18 includes a substantially planar lip 40 formed by an overhanging portion 42 of material 14 on end face 38.

Male latch member 16 is formed entirely of elastically deformable material 14 and is integrally molded with anvil cover 11 on the end opposite female latch member 18. An end face 44 of male member 16 includes a first planar section 45, a tapered shoulder region 46, a second planar section 47, a substantially planar shoulder region 48 and a third planar section 49. Male member 16 further includes a tapered front portion 50, a base portion 52, a tapered rear portion 54 and a planar rear portion 55. Tapered front portion 50 on male member 16 is complementary to tapered section 32 on female member 18.

Figure 2:
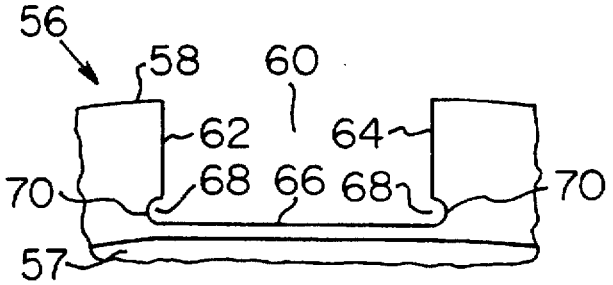
FIG. 2 PRIOR ART
FIG. 2 is a cross-sectional view of a prior art anvil head assembly onto which the present invention is installed.

FIG. 2 shows one type of a conventional anvil head 56 in which the anvil head 56 includes a metal cylinder 57 surrounded by a two-piece cylindrical slip bearing 58 of hard polyurethane or metal. One piece of slip bearing 58 has a transverse, longitudinal slot 60 disposed therein. Slot 60 includes two substantially parallel side walls 62 and 64 and a base wall 66. Slot 60 also includes a pair of transverse grooves 68 running between side walls 62 and 64 and base wall 66. Each groove 68 has a curved surface 70.

Operation of the latch assembly 10 of the present invention is as follows. To initially hold anvil cover 11 in place around slip bearing 58, female member 18 is inserted into slot 60 such that angled section 28 of female member 18 is inserted into one of the grooves 68, as shown in FIG. 3. This is accomplished by initially angling lower segment 26 of female member 18 into the top of slot 60 with angled section 28 lowermost. Angled section 28 is then slipped into groove 68 and a downward pressure is applied to the top of material 14 above female member 18 to force the rest of female member 18 into slot 60. When in place, side segment 24 abuts side wall 62 and lower segment 26 rests on top of base wall 66 with angled section 28 positioned in groove 68. Angled section 28 is in close proximity to surface 70 of groove 68. Anvil cover 11 is then wrapped around slip bearing 58 until male member 16 is opposite female member 18. Planar shoulder region 48 of male member 16 is then hooked under lip 40 as shown in FIG. 3. This configuration holds anvil cover 11 in place around slip bearing 58 until male member 16 can be mated with female member 18.

To finally lock anvil cover 11 to slip bearing 58, male member 16 is angled into female member 18 such that lower shoulder 48 is hooked under locking edge 36. Downward pressure is applied to the top of material 14 above male member 16, for example, by tapping with a mallet. Male member 16 is thus forced into a final locked position in female member 18 as shown in FIG. 4. When in final locked position, tapered front portion 50 of male member 16 abuts tapered section 32 of female member 18, third planar section 49 on male member 16 abuts second section 34 on female member 18, lower shoulder 48 abuts locking edge 36 and angled section 28 is located within groove 68 in close proximity to surface 70. The above latch assembly 10 securely holds anvil cover 11 to slip bearing 58 and prevents the formation of transverse humps or ridges on the upper surface of anvil cover 11. To unlatch anvil cover 11, a flat object, such as a screwdriver, can be inserted between base segment 26 and base portion 52 of male member 16 to remove male member 16 from female member 18.

Although the term "anvil cover" is used to identify element 11 shown in FIGS. 1, 3 and 4, the term is also intended to include rotary die or anvil blankets as well which are terms normally intended to define members attached to fixed drums and the like.

While the preferred embodiment of the invention has been described in detail herein, it would be appreciated by those skilled in the art that various modifications and alternatives to the embodiment could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. An anvil cover latch assembly comprising:

at least one of an anvil head and a slip bearing having a cylindrical periphery provided with a slot, wherein the slot includes opposed, substantially parallel side walls, a base wall and at least one groove having a curved surface provided along the slot adjacent the base wall;

a male member having a planar shoulder region and a rear portion;

a female member, wherein said female member includes a generally U-shaped frame having an upper segment with an inner surface, a side segment and a base segment configured to form a channel;

means for holding said female member in the slot, wherein said holding means includes an angled end section on an end of said base segment remote from said side segment with said base segment configured such that when said male member engages said female member, a portion of said angled end section extends beyond said rear portion of said male member into the groove and substantially abuts the curved surface of the groove; and an insert of an elastically deformable material disposed in said channel such that a locking edge is formed by an exposed portion of said inner surface of said upper segment.

2. A latch assembly as claimed in claim 1, wherein said male member includes a base portion and a tapered shoulder region, with said planar shoulder region positioned between said base portion and said tapered shoulder region.

3. An anvil cover latch assembly as claimed in claim 1, wherein said male member includes a tapered rear portion and wherein when said male member engages said female member, a portion of said angled end section of said female member is spaced from said tapered rear portion of said male member.

4. A latch assembly as claimed in claim 1, further including an elastically deformable cover with said male and female members disposed on opposite ends of said elastically deformable cover.

5. A latch assembly as claimed in claim 4, wherein said cover includes an end face adjacent said female member and wherein said end face includes a lip, with said planar shoulder region of said male member adapted to abut said lip.

6. A latch assembly as claimed in claim 4, wherein said male member is integrally formed at one end of said cover.

7. A latch assembly as claimed in claim 4, further including a flexible band having an outer surface and an inner surface, wherein said cover is disposed on said outer surface of said flexible band.

8. A latch assembly as claimed in claim 7, wherein said female member is attached to said inner surface of said flexible band at one end of said flexible band.

9. An anvil cover, comprising:

at least one of an anvil head and a slip bearing having a cylindrical periphery provided with a slot, wherein the slot includes opposed, substantially parallel side walls, a base wall and at least one groove having a curved surface provided along the slot adjacent the base wall;

a cover body of elastically deformable material configured to encircle the anvil head, said cover body having an inner side which faces the anvil head;

a flexible metal band having an outer surface and an inner surface, with said outer surface of said metal band attached to said inner side of said cover body;

a male member having a planar shoulder region and a rear portion;

a female member disposed at one end of said cover body and configured to be inserted into the slot, wherein said female member includes a generally U-shaped frame having an upper segment with an outer surface, a side segment and a base segment configured to form a channel, wherein said upper segment includes an inner surface, and wherein said outer surface of said upper segment is attached to said inner surface of said metal band;

means for holding said female member in said slot, wherein said holding means includes an angled end section on an end of said base segment remote from said side section with said base segment configured such that when said male member engages said female member, a portion of said angled end section extends beyond said rear portion of said male member into the at least one groove in close proximity to the curved surface; and an insert of elastically deformable material disposed in said U-shaped channel such that a locking edge is formed by an exposed portion of said inner surface of said upper segment, wherein said male member is disposed at the opposite end of said cover body from said female member, wherein said male member is integrally formed with said cover body and said male member is configured to engage said female member.

10. An anvil cover as claimed in claim 9, wherein said male member further includes a tapered shoulder region spaced from said planar shoulder region and said anvil cover further includes an end face adjacent said female member, with said end face having a lip configured to engage said planar shoulder region of said male member.

11. An anvil cover as claimed in claim 9, wherein when said male member engages said female member a portion of said angled end section of said female member is spaced from said tapered rear portion of said male member and said angled end section is also spaced from said metal band.

12. An anvil head assembly comprising:

an anvil head, wherein said anvil head includes a cylindrical periphery having a slot with opposed side walls, a base wall and at least one groove; and an anvil cover, wherein said anvil cover includes a latch assembly comprising:

a male member;

female member having a side segment and a base segment; and means for holding said female member in said slot, said holding means comprising an angled end section on an end of said base segment remote from said side segment configured such that when said male member engages said female member, a portion of said angled end section extends into said at least one groove.

13. An anvil head assembly as claimed in claim 12, wherein said male member includes a tapered rear portion and wherein when said male member engages said female member a portion of said angled end section is spaced from said tapered rear portion of said male member.

* * * * *